US005845904A

United States Patent [19]

Hawkins

[11] Patent Number: 5,845,904

[45] Date of Patent: Dec. 8, 1998

[54] CYLINDRICAL SLIDE PUZZLE

[76] Inventor: Victor J. Hawkins, 1006 Pope St., St. Helena, Calif. 94574

[21] Appl. No.: 914,434

[22] Filed: Aug. 19, 1997

[51] Int. Cl.[6] ..... A63F 9/08

[52] U.S. Cl. ..... 273/153 S

[58] Field of Search ..... 273/153 R, 153 S, 273/157 R; 215/10, 44

[56] References Cited

U.S. PATENT DOCUMENTS

| | | | |
|---|---|---|---|
| 2,488,611 | 11/1949 | Stallings | 215/10 |
| 2,836,323 | 5/1958 | Robinson | 215/10 |
| 4,410,179 | 10/1983 | Rubik . | |
| 4,949,969 | 8/1990 | Johnson . | |
| 5,074,561 | 12/1991 | Johnson . | |
| 5,083,788 | 1/1992 | Conotter | 273/153 S |
| 5,116,053 | 5/1992 | Blankenburg et al. . | |
| 5,259,619 | 11/1993 | Rosewarne . | |
| 5,267,732 | 12/1993 | Bowen et al. | 273/153 S |
| 5,429,364 | 7/1995 | Chang . | |

FOREIGN PATENT DOCUMENTS 1199351 1/1986 Canada .

OTHER PUBLICATIONS

Puzzles 1986 p. 138.
Playthings Aug. 1981 p. 42 P.G. Co. Puzzle.
Playthings Nov. 1981 p. 31 P.G. Co. Puzzle.

*Primary Examiner*—Steven Wong
*Attorney, Agent, or Firm*—Feix & Feix; Tom Hamill

[57] ABSTRACT

A cylindrical slide puzzle system including a cylindrical member, such as an open cylinder, cup or mug, having a slide puzzle incorporated with an outer cylindrical surface thereof. The slide puzzle includes a plurality of slide puzzle elements or pieces which are preferably arranged to form three horizontal rows between the top and bottom edges of the open cylindrical member, cup or mug—this allows for better fit as the slide puzzle elements proximate both the top and bottom are firmly held in place along at lease one side surface and a better fit is assured between the puzzle pieces. A single jamb or vertical stop extending between the top and the bottom edges of the cylindrical member is also provided. A handle, if desired, may be attached to the jamb so as to convert the cylindrical member from a cup to a mug in the case where a solid bottom wall is provided. This jamb serves as part of the frame of the puzzle. In a second embodiment, the cylindrical member is equipped with mutual interengagement structure on the top and bottom edges, preferably matching male and female threads, so as to permit interconnection between respective upper and lower edges of adjacently stacked and similarly constructed cylindrical members. This permits one to create a larger and more complex cylindrical slide puzzle and/or hold a greater volume of material.

18 Claims, 2 Drawing Sheets

CYLINDRICAL SLIDE PUZZLE

BACKGROUND OF THE INVENTION

1. Field of the Invention

The present invention relates to a novel slide puzzle that is provided in combination with a cylindrical member. Specifically, it relates to a slide puzzle mounted within a frame arranged on the outside facing surface of a cylinder, cup or mug. More specifically, it relates to a puzzle of the sliding type mounted within a frame where the sliding puzzle pieces are arranged in such a configuration that the inadvertent dislodgement of the pieces is minimized both during manipulation of the puzzle and during washing of the puzzle carrying mug or cup.

2. Description of the Prior Art

Cups or mugs carrying advertising or decorative indicia are very common and often are used for promotional purposes by various organizations. Oftentimes these items are handed out at trade shows or obtained by redeeming merchandising coupons or the like. One of the drawbacks of this strategy in getting one's message or logo out into the public eye is in that these cups or mugs are often discarded, lost, or relegated to a back shelf or closet. Thus, there exists a need for a device of this nature that is more than a passive receptacle for liquids and that will engage the attention of the user to ensure that the cup or mug will not be so readily discarded or forgotten. The present invention addresses this need by providing a puzzle on the outside of the cup or mug, the puzzle being of a known type that is not onerous to solve, and that does not interfere with the normal use of the cup or mug.

During a search at the United States Patent and Trademark Office, a number of patents were uncovered that are relevant, and they are discussed hereinbelow:

The first is U.S. Pat. No. 5,116,053 issued on May 26, 1992 to Karl Blankenburg, et al. In this invention there is disclosed a tube with a plurality of concentrically rotatable gears mounted on the outside. The gears carry slide elements that can be moved to an adjacent gear having an empty slot or carrying portion. This is unlike the instant invention in that the slide elements in Blankenburg et al. are carried on the supports integral with the rotatable gears.

The other patent found to be of interest is U.S. Pat. No. 5,429,364 issued on Jul. 4, 1995 to Kun-Sheng Chang. This is a cup/puzzle combination having the sliding elements interengageable with both one another and a peripheral frame. Unlike the present invention however, Chang describes a pair of jambs that are attached to the cylindrical walls of the cup and in the figures they are shown as being on opposite sides of the cup In the instant invention, only a single jamb is used, as this increases the area of the outer wall of the cup or mug used for the puzzle and, thus, the possible complexity of the resulting puzzle.

Thus, while the foregoing body of prior art indicates it to be well known to combine a sliding puzzle contained within a frame and a cup or a mug, the present invention does so in a novel and convenient manner. Additionally, the provision of a more simple and cost effective device as provided for in the following description of the instant invention is not contemplated in the art discussed above. Nor does the prior art described above teach or suggest the novel arrangement that allows for a minimal amount of "slop" between the sliding elements of the puzzle to prevent the pieces from inadvertently being displaced during manipulation and washing. The foregoing disadvantages inherent in the prior art are overcome by the unique construction of the present invention as will be made apparent from the following description thereof. Other advantages of the present invention over the prior art also will be rendered evident.

SUMMARY OF THE INVENTION

To achieve the foregoing and other advantages, the present invention, briefly described, provides an improved cylindrical slide puzzle combination wherein the outer cylindrical wall of the cylindrical member is made up of tiled sliding elements. Three of these elements are set between the top and bottom edges of the cylindrical member—this allows for better fit as the elements proximate both the top and bottom edges are firmly held in place and a better fit is assured between the puzzle pieces. A single jamb or vertical stop is provided, also extending between the top and the bottom edges to allow a handle, if desired, to be attached to the cylindrical member. This jamb serves as part of the frame of the puzzle. In a second embodiment, the cylindrical member may be equipped with a removable bottom and interengagement means, such as threads, that are incorporated into the upper and lower lips, allowing a desired number of similarly constructed cylindrical members units to be stacked one atop another. This permits one to create a larger and more complex cylindrical slide puzzle and/or hold a greater volume of material.

The cylindrical members may include open cylinders or may be provided with a solid bottom wall so as to form a cup or even a mug in the case where a handle is provided to the jamb.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention is to provide a cylindrical slide puzzle combination where the number of sliding puzzle elements that may fit between the bottom and the top of the cylindrical member is three to obviate the accidental displacement of one or more of the elements during use or maintenance.

Another object of the present invention is to provide a cylindrical slide puzzle combination wherein a single jamb is provided extending between the top and the bottom of the cylindrical member to frame the puzzle and to allow a handle to be attached, if desired.

Still a further object of the present invention is to provide a cylindrical slide puzzle system which includes a plurality of similarly constructed cylindrical members and wherein each cylindrical member is provided with threaded interengagement structure along top and bottom edges to permit end to end stacking of the cylindrical members so as to form a larger and more complex slide puzzle or to increase the volume of material that may be held by the combined system.

It is another object of the present invention to provide a cylindrical slide puzzle combination that may be easily and efficiently manufactured and marketed.

It is a further objective of the present invention to provide a cylindrical slide puzzle combination that is of durable and reliable construction.

An even further object of the present invention is to provide a cylindrical slide puzzle combination which is susceptible of a low cost of manufacture with regard to both materials and labor, and which accordingly is then susceptible of low prices of sale to the consuming public, thereby making such a cylindrical slide puzzle combination available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENTS

With reference now to the drawings, a cylindrical member and slide puzzle combination embodying the principles and concepts of the present invention will be described.

Figure 1:
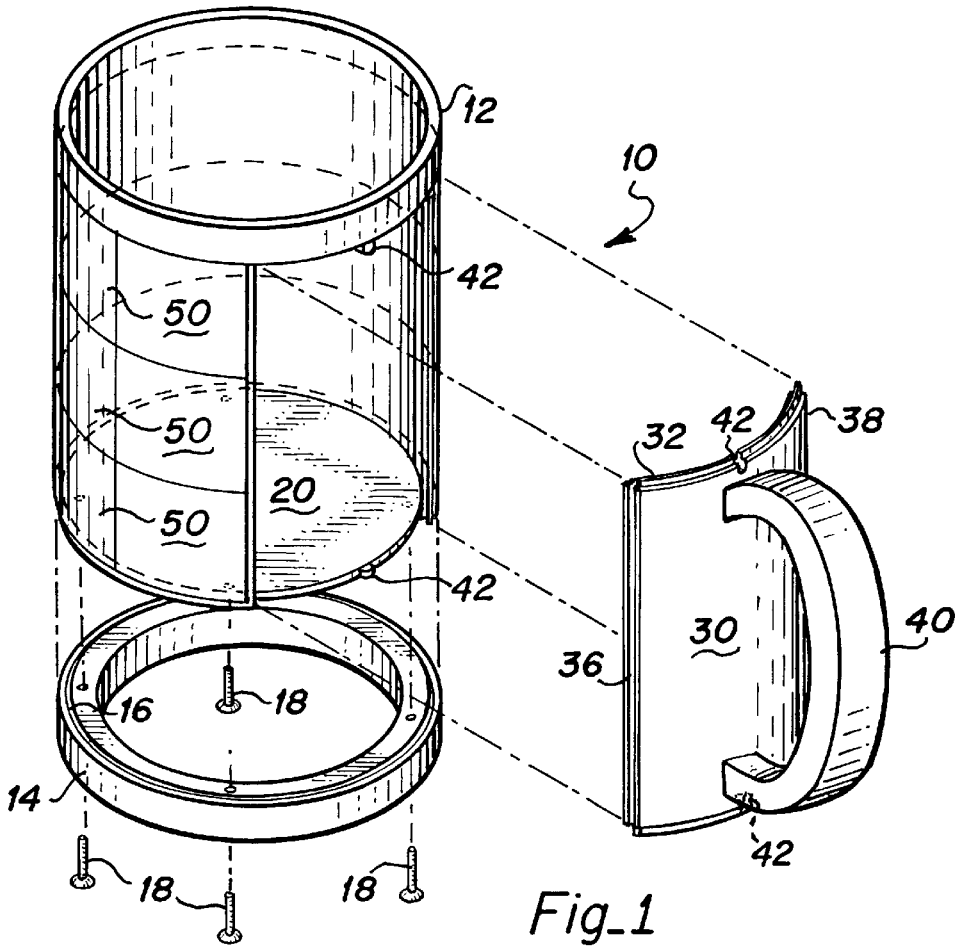
FIG. 1 is an exploded perspective view of the present invention, showing the construction of a first embodiment of the cylindrical slide puzzle in the form of a mug and including details of the jamb and handle and the bottom flange or frame portion.

Turning initially to FIG. 1, there is shown a first embodiment of the invention generally designated by reference numeral 10. In this embodiment, the combination cylindrical member and slide puzzle takes the form of a mug with a handle. Extending around the lip of the mug 10 is an upper lip flange 12. Upper lip flange 12 has a groove therein, to accept the ridges on the sliding puzzle elements, as will be explained in more detail hereinbelow. This groove in the upper lip flange 12 is similar to that seen in the base flange 14. This lower groove is designated at 16 in FIG. 1. Base flange 14 is attached to the base of the mug 10 by threaded engagement means 18. As shown In FIG. 1, these are seen to be screws, but it should be understood that other types of engagement structure could be used. Additionally, in FIG. 1, the mug 10 has a bottom wall 20 formed integral therewith. This bottom wall 20 could also be integral with the base flange 14, as will be discussed further below. In all the embodiments of the present invention discussed herein, the mug or cup body is generally cylindrical and one section of the cylinder is the jamb or stop portion, designated here in FIG. 1 by reference numeral 30. This jamb 30 has a top edge 32, a bottom edge 34, a first side 36, and a second side 38. In the first embodiment shown in FIG. 1, the jamb 30 has attached to it a handle 40. This handle could be integrally molded with the body of the jamb 30, or it could be otherwise attached. The jamb 30 could be either integral with the mug 10 or could be removable. Various attachment means, such as snap fittings, designated in FIG. 1 as reference numeral 42 could be used in the second case.

Figure 5:
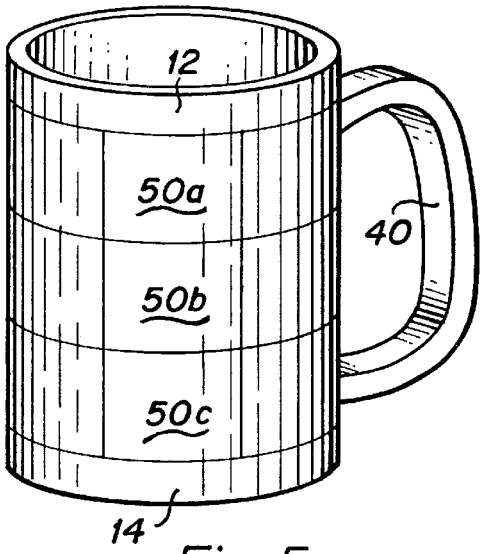
FIG. 5 is a perspective view of the embodiment shown in FIG. 1.

The body portion of the mug 10, as mentioned above, is generally cylindrical. On the outside of the cylindrical wall are located sliding puzzle elements 50. These sliding puzzle elements 50 are designed in the same way such that they may interact with one another in the same manner as that used in U.S. Pat. No. 5,429,364, issued to Chang, mentioned above, which is hereby incorporated by reference. These sliding element within frame type puzzles are old, and it is not deemed necessary to detail their construction. So many various combinations of tongue and groove engagement surfaces are possible that a skilled practitioner would have no difficulty in designing a combination to fit specific needs. The salient feature of the present invention is that in the frame, from the top to the bottom frame area of each cup or mug unit, there are spaced three sliding elements 50. In FIG. 5, for example, these are designated, respectively (from top to bottom) as reference numerals 50*a*, 50*b*, and 50*c*. This number of elements coaxial to the longitudinal axis of the cylinder of each cup portion is important as it has been found that three and only three elements provides for a minimum of "slop" or play between them. In previous cup and puzzle combinations, with four and more elements longitudinally, the middle sliding puzzle elements, being surrounded on all four sides by other movable pieces, had a tendency to work loose and fall out during rough handling, or if the device was placed within a dishwasher.

In the present invention, sliding puzzle elements in the top an bottom rows are bounded by at least one non-movable boundary (i.e., upper lip flange 12 and base flange 14) and only one middle row of sliding puzzle elements is bounded by other movable pieces along all four sides. This design allows for greater tolerance in the "fit" of the corresponding tongue and groove structure of the adjacent sliding puzzle pieces before the middle row of sliding puzzle elements becomes too loosely contained. The desired "tightness" or close tolerance fit of the sliding puzzles elements 50 can also be achieved by exaggerating the dimension of the interengaging tongue-in-groove type flange structure on the individual slide puzzle elements. Some of this interengaging flange structure is visible in FIG. 2 being indicated by reference numeral 51.

Another salient feature of the present invention is that there is a single jamb or stop 30. The first side and the second side 36, 38 provide two edges of the puzzle frame in which the sliding elements 50 move. A cylindrical slide puzzle with a single vertical jamb is more desirable than a cylindrical slide puzzle with two jambs since it offers greater puzzle complexity since a portion of the entire slide puzzle is not visible to the user. In the two jamb slide puzzle mugs of the prior art, the two jambs divide the cylindrical surface of the mug into two separate slide puzzle portions such that the entire puzzle area of at least one of the slide puzzle portions can be completely viewed and hence more easily solved.

Figure 6:
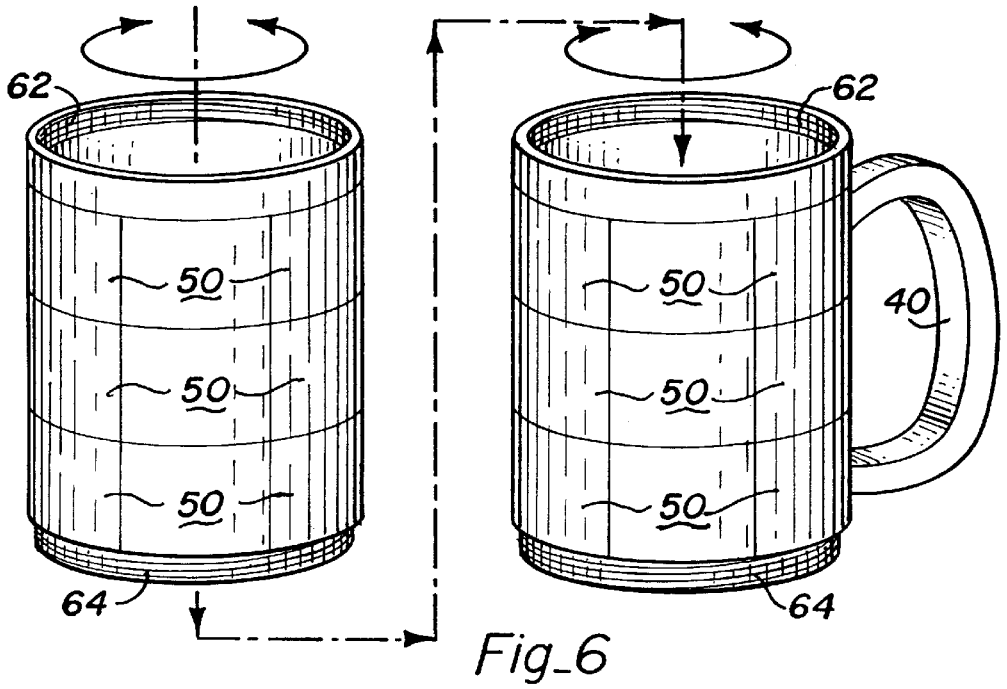
FIG. 6 is an expanded perspective view showing interengagement of the cup portion of the embodiment shown in FIG. 1 and one of the cup portions shown in FIG. 2.
Figure 2:
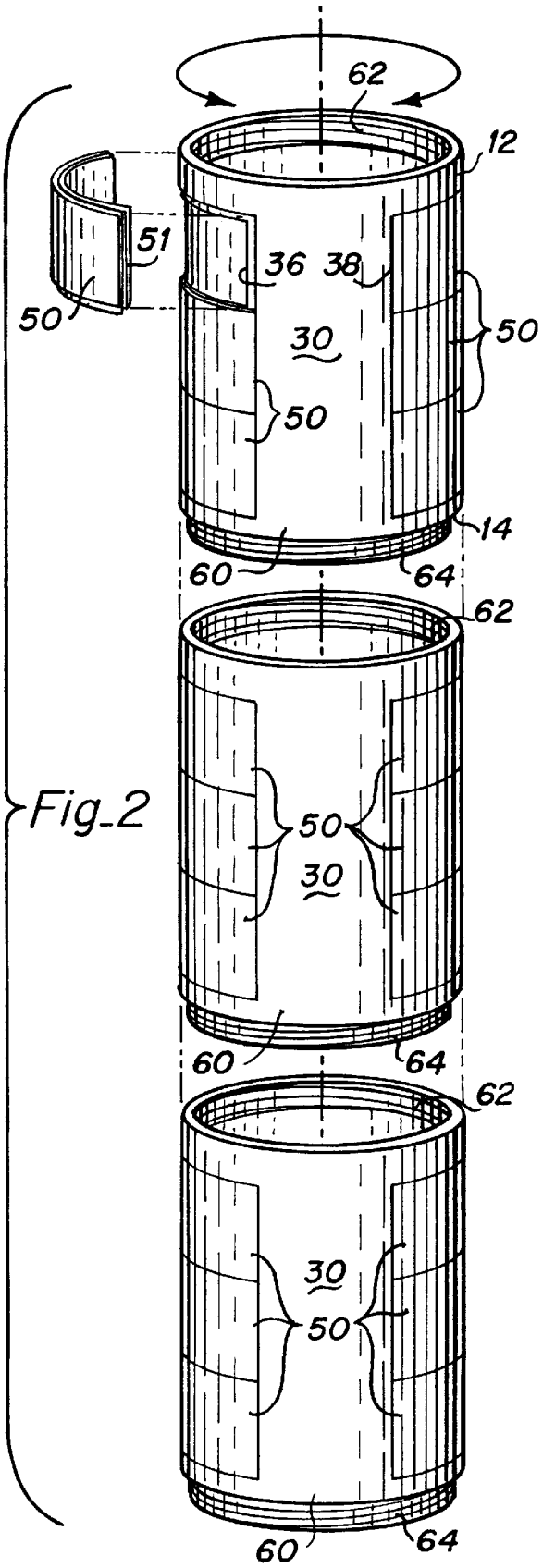
FIG. 2 is an exploded perspective view of the invention showing a second embodiment of the invention that provides for an interengagement between similarly constructed cylindrical members, and also shows one of the sliding puzzle elements removed from the puzzle frame on the outer cylindrical wall of the cylindrical member.

Turning to an alternative embodiment shown in FIG. 2 and FIG. 6, the cylindrical bodies 60 are seen with interengagement means in the form of male and female cooperating threads. The female thread receiving areas 62 are located on the upper flange or lip portion of the cylindrical bodies 60 and the male thread areas 64 are located on the lower or base portion of the cylindrical bodies 60. In FIG. 2 it can be seen that a plurality of cylindrical bodies can be attached together to form a larger container, extending longitudinally as far as the user desires. This could be done to provide a larger, more intricate puzzle as well as providing a larger container volume. Note that in FIG. 2 that all the jambs 30 are smooth; i.e not provided with handles and that in FIG. 6, though the jambs 30 cannot be seen, the handle 40 is attached to the one cylindrical body 60 on the right of the Figure. As mentioned above, the handle 40 can be attached in a variety of ways so that the potential configurations of the instant invention are almost unlimited.

Figure 3:
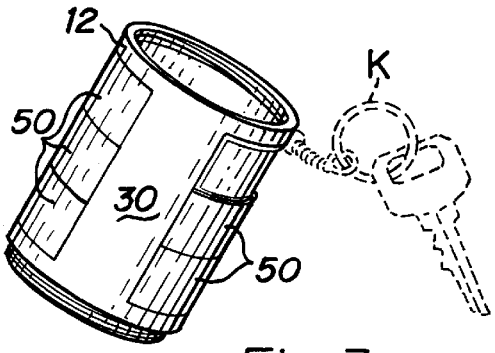
FIGS. 3 and 4 are perspective views showing an alternative embodiment wherein the cylindrical slide puzzle combination is attached to a key chain.
Figure 4:
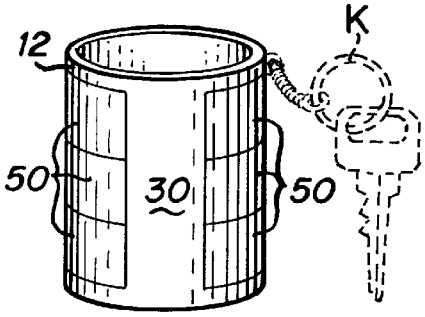

Turning to FIGS. 3 and 4, another embodiment of the present invention is shown. In this embodiment, an accessory or utensil K is attached to the upper flange or lip portion 12, in this case a key ring. In this embodiment as shown, no handle is seen attached to the jamb 30, but it should be understood that this is in no way a limitation as a skilled practitioner could easily add one, if desired.

The types of indicia or markings on the sliding puzzle elements 50 could be of any type. Pictures, abstract designs, logos, humorous sayings, or announcements of special business or social events (herein referred to collectively as "artwork") could be placed thereon. The artwork could be printed or otherwise formed only on the individual slide puzzle elements, or if desired, the artwork could extend beyond the sliding puzzle elements and also run over onto the top and bottom border regions (i.e., lip flange 12 and base flange 14) and the jamb 30. Further interesting puzzle effects could be created by placing artwork or hidden messages on the outer wall surface of the cylinder member underlying the sliding puzzle elements.

Additionally, it is contemplated that the sliding puzzle elements could be three dimensional—that is that they could extend axially outwardly, sculpted to fit together in a certain manner to create a pleasing or humorous shape.

It is apparent from the above that the present invention accomplishes all of the objectives set forth by providing a cup and puzzle combination that overcomes the disadvantages of the prior art and allows the user to amuse themselves with solving the puzzle in idle moments while at the same time enjoying the contents of the cup or mug.

It should be noted that once the basic mold has been created for a preferred size of the cylindrical bodies 60 and the optimum sizing for the sliding puzzle elements 50 has been determined, many different types of indicia could be economically inscribed on the pieces 50 with only minimal expenses. Thus a wide variety of organizations could take advantage of the present invention for advertising, fund raising, promotions, or the like.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A cylindrical slide puzzle combination comprising:

an open cylindrical container member having an outer cylindrical wall with a lower edge and an upper edge;

an upper lip flange located proximate said upper edge and a base flange located proximate said lower edge;

a sliding element stop means comprising a generally rectangular surface extending between said upper edge and said lower edge and having a first puzzle retaining edge and a second puzzle retaining edge, said first and second puzzle retaining edges being distal from one another and the first puzzle retaining edge including a groove extending from said upper edge to said lower edge of said cylindrical wall and the second puzzle retaining edge including a ridge extending from said upper edge to said lower edge of said cylindrical wall, thus forming a jamb such that a sliding element puzzle frame is formed;

a plurality of sliding puzzle elements each having four edges, and each having a first groove defined in a first element edge, a first ridge formed on the element edge distal to said first element edge, a second groove defined in a second element edge, said second element edge being generally perpendicular to said first element edge, and a second ridge formed on the element edge distal to said second element edge; and mutually interengageable thread means located on said upper lip flange and said base flange, said interengageable thread means including a male and female portion and where said male portion is located proximate said base flange and said female portion is located proximate said upper lip flange such that a system of cylindrical container members may be mounted one atop the other, cooperatively engaging to form a larger cylindrical puzzle having a continuously smooth external cylindrical wall and an enlarged continuous container volume.

2. The cylindrical slide puzzle combination according to claim 1, wherein the number of said sliding puzzle elements that can fit in said puzzle frame between said upper edge and said lower edge is three.

3. The cylindrical slide puzzle combination according to claim 1, wherein said sliding puzzle element stop means further includes a handle means.

4. A cylindrical slide puzzle comprising:

an open cylindrical container member having an outer cylindrical wall with a lower edge and an upper edge;

an upper lip flange located proximate said upper edge and a base flange located proximate said lower edge;

a single vertical jamb extending between said upper edge and said lower edge and having a first puzzle retaining edge and a second puzzle retaining edge, said first and second puzzle retaining edges being distal from one another and the first puzzle retaining edge including a groove extending from said upper edge to said lower edge of said cylindrical wall and the second puzzle retaining edge including a ridge extending from said upper edge to said lower edge of said cylindrical wall;

a plurality of sliding puzzle elements each having four edges, and each having a first groove defined in a first element edge, a first ridge formed on the element edge distal to said first element edge, a second groove defined in a second element edge, said second element edge being generally perpendicular to said first element edge, and a second ridge formed on the element edge distal to said second element edge; and mutually interengageable thread means located on said upper lip flange and said base flange, said interengageable thread means including a male and female portion and where said male portion is located proximate said base flange and said female portion is located proximate said upper lip flange such that a system of similarly constructed cylindrical container members may be mounted one atop the other in cooperative engagement to form a larger cylindrical slide puzzle having a continuously smooth external cylindrical wall and an enlarged continuous container volume.

5. The cylindrical slide puzzle according to claim 4, wherein the number of said sliding puzzle elements that can fit in said puzzle frame between said upper edge and said lower edge is three.

6. The cylindrical slide puzzle according to claim 4, wherein said jamb further includes a handle formed thereon.

7. A cylindrical slide puzzle system comprising:

a) a plurality of open cylindrical container members, wherein each cylindrical container member includes:

i) an outer cylindrical wall with a lower edge and an upper edge;

ii) an upper lip flange located proximate said upper edge and a base flange located proximate said lower edge;

iii) a single vertical jamb extending between said upper edge and said lower edge and having a first puzzle retaining edge and a second puzzle retaining edge, said first and second puzzle retaining edges being distal from one another and the first puzzle retaining edge including a groove extending from said upper edge to said lower edge of said cylindrical wall and the second puzzle retaining edge including a ridge extending from said upper edge to said lower edge of said cylindrical wall;

iv) a plurality of sliding puzzle elements each having four edges, and each having a first groove defined in a first element edge, a first ridge formed on the element edge distal to said first element edge, a second groove defined in a second element edge, said second element edge being generally perpendicular to said first element edge, and a second ridge formed on the element edge distal to said second element edge; and b) each of said cylindrical container members includes interengagement means adapted to permit releasable engagement between respective upper lip and base flanges of two or more adjacently stacked cylindrical container members so as to form a larger cylindrical slide puzzle having a continuously smooth external cylindrical wall and an enlarged continuous container volume.

8. The cylindrical slide puzzle system according to claim 7, wherein said interengagement means comprises a plurality of male threads located on said base flange and a plurality of female threads located on said upper lip flange.

9. The cylindrical slide puzzle system according to claim 7, wherein said jamb further includes a handle formed thereon.

10. The cylindrical slide puzzle combination according to claim 1, which includes a key chain attached to one of said upper lip flange or said base flange.

11. The cylindrical slide puzzle combination according to claim 1, which includes a bottom wall removably attachable to said base flange.

12. The cylindrical slide puzzle combination according to claim 11, wherein said jamb further includes a handle formed thereon.

13. The cylindrical slide puzzle according to claim 4, which includes a key chain attached to one of said upper lip flange or said base flange.

14. The cylindrical slide puzzle according to claim 4, which includes a bottom wall removably attachable to said base flange.

15. The cylindrical slide puzzle according to claim 14, wherein said jamb further includes a handle formed thereon.

16. The cylindrical slide puzzle system according to claim 7, wherein at least one of said cylindrical container members includes a key chain attached to a respective one of said upper lip flange or said base flange.

17. The cylindrical slide puzzle system according to claim 7, wherein at least one of said cylindrical container members includes a bottom wall removably attachable to a respective base flange thereof.

18. The cylindrical slide puzzle system to claim 17, wherein said jamb further includes a handle formed thereon.

* * * * *